US006838133B2

(12) United States Patent
Matsumura et al.

(10) Patent No.: US 6,838,133 B2
(45) Date of Patent: Jan. 4, 2005

(54) INK JET PRINTING PAPER

(75) Inventors: Kazuyuki Matsumura, Gunma-ken (JP); Akira Yamamoto, Gunma-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/051,115

(22) Filed: Jan. 22, 2002

(65) Prior Publication Data

US 2002/0136869 A1 Sep. 26, 2002

(30) Foreign Application Priority Data

Jan. 24, 2001 (JP) ..... 2001-015372

(51) Int. Cl.[7] ..... B41M 5/40

(52) U.S. Cl. ..... 428/32.21; 428/32.34; 427/243

(58) Field of Search ..... 428/32.21, 32.34, 428/195, 447, 452, 511, 537.5; 427/243

(56) References Cited

U.S. PATENT DOCUMENTS 3,575,910 A 4/1971 Thomas ..... 260/29.6

FOREIGN PATENT DOCUMENTS

| | | |
|---|---|---|
| EP | 0 841 355 A2 | 5/1998 |
| EP | 0 943 634 A1 | 9/1999 |
| EP | 1 226 971 A2 * | 7/2002 |
| JP | 2000-52641 | 2/2000 |

* cited by examiner

*Primary Examiner*—B. Shewareged
(74) *Attorney, Agent, or Firm*—Birch, Stewart, Kolasch & Birch, LLP

(57) ABSTRACT

A printing paper sheet is provided in which cellulose fibers are coated with solids of a substantially organic solvent-free silicone resin emulsion composition which is obtained by emulsion polymerization of a mixture comprising (a) a singly water insoluble, silanol group-bearing silicone resin and/or a radical polymerizable vinyl group-bearing alkoxysilane and (b) a radical polymerizable vinyl monomer. The paper sheet in which cellulose fibers are coated with the acrylic silicone resin is minimized in deformation or stretching and contraction upon water absorption and thus suited for printing by an ink jet printer. The quality of printed image is equal to ordinary coated paper sheets.

10 Claims, No Drawings

INK JET PRINTING PAPER

This invention relates to ink jet printing paper sheets which have improved dimension stability in that they experience minimized deformation when printed by an ink jet printer, and which afford a high color development density, gloss and sharp hue in the recorded state.

BACKGROUND OF THE INVENTION

In the recent years, ink jet printers are marketed at a reasonable price and widely used in printing on a variety of media. Paper sheets specialized for use with ink jet printers are commercially available in order that the ink jet printed matter be endowed with better properties including sharpness and gloss. The paper sheets specialized for use with ink jet printers have a smooth ink receiving layer on a surface of paper substrate so that the ink may develop its color in an aesthetic manner without bleeding. To this end, the paper substrate supporting the ink receiving layer is moderately hygroscopic. Then the paper substrate must be relatively thick because paper generally has the nature that on moisture absorption, it stretches and contracts, resulting in cockles.

However, thick paper sheets are bulky in volume and add to the cost. When piled up, thick paper sheets tend to come in close contact to increase the risk that two or more paper sheets are simultaneously fed from the feeder to the printer. The problem may be solved by impregnating paper with a resin. However, there is available no resin that has both moisture absorption and contraction resistance. For example, when paper is impregnated with an epoxy resin, good contraction resistance is endowed at the sacrifice of moisture absorption. When hygroscopic polymers such as polyvinyl alcohol are used for impregnation, good moisture absorption is obtained with no improvement in contraction resistance. Another approach is to blend cellulose fibers with other fibers such as glass fibers, but at the risk of degrading good printability inherent to paper.

JP-A 2000-52641 discloses a low contractible printing paper sheet which has been treated with a specific silane hydrolyzate. This treatment is effective for improving stretching/contracting properties. However, this treatment as such is difficult to improve print quality, requiring the additional step of coating with another resin.

SUMMARY OF THE INVENTION

Therefore, an object of the invention is to provide an ink jet printing paper sheet which even when aqueous ink is applied thereto as by ink jet printers, experiences minimized deformation or stretching/contraction and ensures satisfactory print quality.

The inventors have found that when cellulose fibers of paper are coated at least in part with solids of a substantially organic solvent-free, silicone resin-containing emulsion composition obtained by emulsion polymerizing a mixture containing a silanol group-bearing silicone resin and/or a radical polymerizable vinyl group-bearing alkoxysilane and a radical polymerizable vinyl monomer, there is obtained an ink jet printing paper sheet which when printed by an ink jet printer, is minimized in deformation or stretching/contraction and affords a high color development density, gloss and sharp hue.

The invention provides an ink jet printing paper sheet comprising cellulose fibers coated at least in part with solids of a substantially organic solvent-free, silicone resin-containing emulsion composition which is obtained by emulsion polymerization of a mixture comprising:

(a) 100 parts by weight of (a-1) a singly water insoluble, silanol group-bearing silicone resin having the following average compositional formula:

$$R^1_mR^2_nSi(OH)_p(OX)_qO_{(4-m-n-p-q)/2}$$

wherein $R^1$ is a monovalent hydrocarbon group having 1 to 10 carbon atoms, $R^2$ is a substituted monovalent hydrocarbon group having 1 to 10 carbon atoms, X is a monovalent hydrocarbon group having 1 to 6 carbon atoms, m, n, p and q are positive numbers satisfying $0.5 \leqq m \leqq 1.8$, $0 \leqq n \leqq 1.0$, $0 < p \leqq 1.5$, $0 \leqq q \leqq 0.5$, $0.5 \leqq m+n \leqq 1.8$, $0 < p+q \leqq 1.5$, and $0.5 < m+n+p+q < 3$, and/or (a-2) a radical polymerizable vinyl group-bearing alkoxysilane having the following general formula:

$$CH_2{=}CR^3R^4_bSiR^5_a(OX)_{3-a}$$

wherein $R^3$ is hydrogen or methyl, $R^4$ is a divalent hydrocarbon group of 1 to 10 carbon atoms which may be separated by an oxygen atom, —COO— group or the like, $R^5$ is a substituted or unsubstituted monovalent hydrocarbon group having 1 to 8 carbon atoms, X is as defined above, "a" is 0 or 1, and "b" is 0 or 1, and (b) 100 to 100,000 parts by weight of a radical polymerizable vinyl monomer.

DESCRIPTION OF THE PREFERRED EMBODIMENT

Silicone Resin-containing Emulsion Composition

The emulsion composition used herein is obtained by emulsion polymerization of a mixture consisting essentially of (a) a silanol group-bearing silicone resin and/or a radical polymerizable vinyl group-bearing alkoxysilane and (b) a radical polymerizable vinyl monomer. The emulsion composition thus obtained is substantially free of an organic solvent and contains the silicone resin of condensation type or silane and the vinyl resin within common particles in the emulsion.

As mentioned just above, the silicone resin-containing emulsion is obtained by emulsion polymerization of a mixture of (a-1) a singly water insoluble, silanol group-bearing silicone resin having the following average compositional formula:

$$R^1_mR^2_nSi(OH)_p(OX)_qO_{(4-m-n-p-q)/2}$$

wherein $R^1$ is a monovalent hydrocarbon group having 1 to 10 carbon atoms, $R^2$ is a substituted monovalent hydrocarbon group having 1 to 10 carbon atoms, X is a monovalent hydrocarbon group having 1 to 6 carbon atoms, m, n, p and q are positive numbers satisfying $0.5 \leqq m \leqq 1.8$, $0 \leqq n \leqq 1.0$, $0 < p \leqq 1.5$, $0 \leqq q \leqq 0.5$, $0.5 \leqq m+n \leqq 1.8$, $0 < p+q \leqq 1.5$, and $0.5 < m+n+p+q < 3$, and/or (a-2) a radical polymerizable vinyl group-bearing alkoxysilane having the following general formula:

$$CH_2{=}CR^3R^4_bSiR^5_a(OX)_{3-a}$$

wherein $R^3$ is hydrogen or methyl, $R^4$ is a divalent hydrocarbon group of 1 to 10 carbon atoms which may be separated by an oxygen atom, —COO— group or the like, $R^5$ is a substituted or unsubstituted monovalent hydrocarbon group having 1 to 8 carbon atoms, X is as defined above, "a" is 0 or 1, and "b" is 0 or 1, and (b) a radical polymerizable vinyl monomer.

In the formula of silanol group-bearing silicone resin (a-1), $R^1$ stands for monovalent hydrocarbon groups having 1 to 10 carbon atoms, preferably free of aliphatic unsaturation, for example, methyl, ethyl, propyl, isopropyl, butyl, t-butyl, hexyl, cyclohexyl, octyl, decyl and phenyl. Of these, methyl, propyl, hexyl and phenyl groups are preferred.

$R^2$ stands for substituted monovalent hydrocarbon groups having 1 to 10 carbon atoms. Applicable substituents include (1) halogen atoms such as fluorine and chlorine, (2) alkenyl groups such as vinyl, (3) epoxy functional groups such as glycidyloxy and epoxycyclohexyl groups, (4) (meth)acrylic functional groups such as methacrylic and acrylic groups, (5) amino functional groups such as amino, aminoethyl, phenylamino and dibutylamino groups, (6) sulfurous functional groups such as mercapto and tetrasulfide groups, (7) (polyoxyalkylene) alkyl ether groups, (8) anionic groups such as carboxyl and sulfonyl groups, and (9) quaternary ammonium salt structure-containing groups. Illustrative, non-limiting, examples of the substituted monovalent hydrocarbon groups include trifluoropropyl, perfluorobutyl ether, perfluorooctylethyl, 3-chloropropyl, 2-(chloromethylphenyl)ethyl, vinyl, 5-hexenyl, 9-decenyl, 3-glycidyloxypropyl, 2-(3,4-epoxycyclohexyl)ethyl, 5,6-epoxyhexyl, 9,10-epoxydecyl, 3-(meth)acryloxypropyl, (meth)acryloxymethyl, 11-(meth)acryloxyundecyl, 3-aminopropyl, N-(2-aminoethyl)aminopropyl, 3-(N-phenylamino)propyl, 3-dibutylaminopropyl, 3-mercaptopropyl, 2-(4-mercaptomethylphenyl)ethyl, polyoxyethylenoxypropyl, 3-hydroxycarbonylpropyl, and 3-tributylammoniumpropyl groups.

For enhancing the adhesion of the silicone resin to paper, it is effective to apply epoxy and amino functional groups. For tight blocking of the silicone resin with the vinyl polymer, it is preferred to use (meth)acrylic functional groups capable of radical copolymerization or mercapto functional groups having the function of a chain transfer agent. When crosslinking with the vinyl polymer is attempted by bonds other than siloxane bonds, desirable results are achievable by introducing functional groups capable of reacting with organic functional groups in the vinyl polymer, for example, epoxy groups (for reaction with hydroxyl, amino and carboxyl groups) and amino groups (for reaction with epoxy and acid anhydride groups).

The OX group represents a hydrolyzable group. X stands for monovalent hydrocarbon groups having 1 to 6 carbon atoms such as alkyl, alkenyl and aryl groups. Illustrative examples of the hydrolyzable group OX include methoxy, ethoxy, propoxy, isopropoxy, butoxy, sec-butoxy, t-butoxy, isopropenoxy, and phenoxy. From the standpoints of hydrolytic condensation reaction and stability in emulsion, it is recommended to use methoxy, ethoxy and isopropoxy groups.

The subscripts m, n, p and q are positive numbers satisfying $0.5 \leqq m \leqq 1.8$, $0 \leqq n \leqq 1.0$, $0 < p \leqq 1.5$, $0 \leqq q \leqq 0.5$, $0.5 \leqq m+n \leqq 1.8$, $0 < p+q \leqq 1.5$, and $0.5 < m+n+p+q < 3$. If $m < 0.5$, the content of non-functional organic group $R^1$ becomes too low, and adhesion to paper becomes poor. If $m > 1.8$, the amount of chain units becomes large, exacerbating stability. More preferably, m is from 0.6 to 1.5. If $n > 1.0$, the content of $R^2$ becomes large, and adhesion to paper becomes poor. The organic functional group $R^2$ need not be included if the function of organic group $R^2$ is not necessary. The optimum range of m+n is set as above for the same reason as the range of m. The inclusion of silanol groups is essential, but the silicone resin becomes unstable when p representative of the content of silanol groups is in excess of 1.5. To provide good shelf stability and tight adhesion to paper, p is preferably selected in the range of 0.05 to 0.8 and more preferably 0.2 to 0.7. The hydrolyzable and hence, crosslinkable group OX may be present in addition to the silanol groups, although its content q must be 0.5 or less. If $q > 0.5$, the silicone resin is liable to hydrolysis in water, producing in the system an alcohol by-product which is an organic solvent, the total number of crosslinkable substituent groups, represented by (p+q), should meet the range: $0 < p+q \leqq 1.5$. No cure occurs if $p+q=0$. The molecule becomes small and water soluble if $p+q > 1.5$.

The silicone resin used herein has to meet the above-mentioned requirements. At the same time, the silicone resin should contain silanol groups and should not be dissolvable in water when alone. If the silicone resin is dissolvable in water, undesirably it is not entirely incorporated into particles during emulsion polymerization. Insofar as the above-mentioned requirements are met, the silicone resin may be prepared by any desired method. However, since simple hydrolysis of a hydrolyzable silane compound in water is insufficient to meet the requirements, illustrative preparation methods are described below.

The reactant from which the silicone resin is prepared may be any of silane compounds containing 1, 2, 3 or 4 hydrolyzable groups (the preferred type of which is chloro or alkoxy) and an organic substituent group meeting the above-mentioned requirements. Exemplary silane compounds include vinyltrichlorosilane, vinyltrimethoxysilane, vinyltriethoxysilane, vinylmethyldichlorosilane, vinylmethyldimethoxysilane, vinylmethyldiethoxysilane, 5-hexenyltrimethoxysilane, 3-glycidoxypropyltrimethoxysilane, 3-glycidoxypropyltriethoxysilane, 3-glycidoxypropylmethyldimethoxysilane, 3-glycidoxypropylmethyldiethoxysilane, 3-(meth)acryloxypropyltrimethoxysilane, 3-(meth)acryloxypropyltriethoxysilane, 3-(meth)acryloxypropylmethyldimethoxysilane, 3-(meth)acryloxypropylmethyldiethoxysilane, 4-vinylphenyltrimethoxysilane, 3-(4-vinylphenyl)propyltrimethoxysilane, 4-vinylphenylmethyltrimethoxysilane, 3-aminopropyltrimethoxysilane, 3-aminopropyltriethoxysilane, 3-aminopropylmethyldimethoxysilane, 3-aminopropylmethyldiethoxysilane, 3-(2-aminoethyl)aminopropyltrimethoxysilane, 3-mercaptopropyltrimethoxysilane, 3-mercaptopropyltriethoxysilane, 3-mercaptopropylmethyldimethoxysilane, and 3-mercaptopropylmethyldiethoxysilane, which are known as silane coupling agents. Also included are tetrachlorosilane, tetramethoxysilane, tetraethoxysilane, tetrabutoxysilane, methyltrichlorosilane, methyltrimethoxysilane, methyltriethoxysilane, methyltriisopropoxysilane, methyltributoxysilane, methyltriisopropenoxysilane, dimethyldichlorosilane, dimethyldimethoxysilane, dimethyldiethoxysilane, dimethyldiisopropoxysilane, dimethyldibutoxysilane, dimethyldiisopropenoxysilane, trimethylchlorosilane, trimethylmethoxysilane, trimethylethoxysilane, trimethylisopropenoxysilane, ethyltrichlorosilane, ethyltrimethoxysilane, propyltrichlorosilane, butyltrichlorosilane, butyltrimethoxysilane, hexyltrichlorosilane, hexyltrimethoxysilane, decyltrichlorosilane, decyltrimethoxysilane, phenyltrichlorosilane, phenyltrimethoxysilane, cyclohexyltrichlorosilane, cyclohexyltrimethoxysilane, propylmethyldichlorosilane, propylmethyldimethoxysilane, hexylmethyldichlorosilane, hexylmethyldimethoxysilane, phenylmethyldichlorosilane, phenylmethyldimethoxysilane, diphenyldichlorosilane, diphenyldimethoxysilane, dimethylphenylchlorosilane and partial hydrolyzates thereof. For ease of operation and distilling off of by-products, use of methoxysilanes or ethoxysilanes is recommended. Useful organosilicon compounds are not limited to those enumerated above. There may be used any one or a mixture of two or more of the foregoing silane compounds.

The following two methods can be employed in hydrolyzing the hydrolyzable silane compound to form a silicone resin which can be used herein. The first method is to hydrolyze the silane compound in an organic solvent which is selected from among aromatic hydrocarbons (e.g., toluene and xylene), hydrocarbons (e.g. hexane and octane), ketone compounds (e.g., methyl ethyl ketone and methyl isobutyl ketone), esters (e.g., ethyl acetate and isobutyl acetate), and alcohols (e.g., methanol, ethanol, isopropanol, butanol, isobutanol and t-butanol). The first method requires to remove the harmful organic solvent from the thus produced silicone resin which is insoluble in water by itself, under atmospheric pressure or in vacuum. It is acceptable to simply remove the organic solvent, leaving a viscous liquid which may be solidified. Alternatively, the high-boiling radical polymerizable vinyl monomer to be used in the subsequent step is added to the hydrolyzed solution, and the low-boiling organic solvent is distilled off in the co-presence of the vinyl monomer whereupon the silicone resin is taken out as an organic solvent-free solution. The second method is to hydrolyze the silane compound (other than chlorosilane) in water. In order to remove the organic solvent and help the silicone resin to grow to a level insoluble in water, the hydrolysis is followed by heating under atmospheric pressure or in vacuum to distill off the organic solvent along with water. In this way, a silicone resin is obtained which is free of an organic solvent, insoluble in water, dispersed in water (or has separated and settled from within water), and rich in silanol groups. After the silicone resin is separated from water, the radical polymerizable vinyl monomer may be added to the resin to form a vinyl monomer solution of the silicone resin. Alternatively, the radical polymerizable vinyl monomer is added to the aqueous solution of the silicone resin whereby the silicone resin is separated as a vinyl monomer solution of the silicone resin.

In effecting hydrolysis, a hydrolytic catalyst may be used. The hydrolytic catalyst may be selected from well-known catalysts and preferably those catalysts which exhibit an acidity of pH 2 to 7 in an aqueous solution thereof. Preferred catalysts include acidic hydrogen halides, carboxylic acids, sulfonic acids, acidic or weakly acidic inorganic salts, and solid acids such as ion exchange resins. Specific examples include hydrogen fluoride, hydrochloric acid, nitric acid, sulfuric acid, organic carboxylic acids as typified by acetic acid and maleic acid, methylsulfonic acid, and cation exchange resins bearing sulfonic or carboxylic groups on the surface. The amount of the hydrolytic catalyst used is preferably 0.001 to 10 mol % based on the moles of hydrolyzable groups on silicon atoms.

Preferably the silicone resin has a number average molecular weight of about 500 to 100,000, and especially about 1,000 to 200,000.

Component (a-2) is a radical polymerizable vinyl group-bearing alkoxysilane having the following general formula.

$$CH_2{=}CR^3R^4{}_bSiR^5{}_a(OX)_{3-a}$$

Herein $R^3$ is hydrogen or methyl. $R^4$ is a divalent hydrocarbon group of 1 to 10 carbon atoms, especially 1 to 6 carbon atoms, for example, alkylene, arylene and alkylarylene groups, which may be separated by an oxygen atom, —COO— group or the like. $R^5$ is a substituted or unsubstituted monovalent hydrocarbon group having 1 to 8 carbon atoms. X is as defined in connection with component (a-1). The subscript "a" is 0 or 1, and "b" is 0 or 1. The unsubstituted monovalent hydrocarbon groups are as described for $R^1$, and the substituted monovalent hydrocarbon groups are as described for $R^2$.

Examples of the alkoxysilane include vinyltrimethoxysilane, vinyltriethoxysilane, vinylmethyldimethoxysilane, vinylmethyldiethoxysilane, 5-hexenyltrimethoxysilane, 3-(meth)acryloxypropyltrimethoxysilane, 3-(meth)acryloxypropyltriethoxysilane, 3-(meth)acryloxypropylmethyldimethoxysilane, 3-(meth)acryloxypropylmethyldiethoxysilane, 4-vinylphenyltrimethoxysilane, 3-(4-vinylphenyl)propyltrimethoxysilane, and 4-vinylphenylmethyltrimethoxysilane. The radical polymerizable vinyl group-bearing alkoxysilane which can be used herein is not limited thereto. Any one or a mixture of two or more of these alkoxysilanes may be used.

Described below is component (b), radical polymerizable vinyl monomer. The radical polymerizable vinyl monomer may be selected from well-known vinyl monomers as long as they are radical polymerizable. Included are (b-1) alkyl (meth)acrylates in which the alkyl moiety has 1 to 18 carbon atoms, for example, the methyl, ethyl, propyl, isopropyl, butyl, isobutyl, octyl, 2-ethylhexyl, lauryl, stearyl and cyclohexyl esters of acrylic acid or methacrylic acid; (b-2) vinyl monomers containing a carboxyl group or anhydride group thereof, for example, acrylic acid, methacrylic acid and maleic anhydride; (b-3) hydroxyl group-containing vinyl monomers, for example, 2-hydroxyethyl (meth)acrylate and 2-hydroxypropyl (meth)acrylate; (b-4) amide group-containing vinyl monomers, for example, (meth)acrylamide, N-methylol (meth)acrylamide, N-methoxymethyl (meth)acrylamide, N-butoxymethyl (meth)acrylamide and diacetone (meth)acrylamide; (b-5) amino group-containing vinyl monomers, for example, dimethylaminoethyl (meth)acrylate and diethylaminoethyl (meth)acrylate; (b-6) alkoxy group-containing vinyl monomers, for example, methoxyethyl (meth)acrylate and butoxyethyl (meth)acrylate; (b-7) glycidyl group-containing vinyl monomers, for example, glycidyl (meth)acrylate and glycidyl allyl ether; (b-8) vinyl ester monomers, for example, vinyl acetate and vinyl propionate; (b-9) aromatic vinyl monomers, for example, styrene, vinyltoluene, and a-methylstyrene; (b-10) vinyl cyanide monomers such as (meth)acrylonitrile; (b-11) vinyl halide monomers such as vinyl chloride and vinyl bromide; (b-12) vinyl monomers containing at least two radical polymerizable unsaturated groups in a molecule, for example, divinylbenzene, allyl (meth)acrylate, ethylene glycol di(meth)acrylate, diethylene glycol di(meth)acrylate and trimethylolpropane tri(meth)acrylate; (b-13) (poly)oxyethylene chain-containing vinyl monomers such as (poly)oxyethylene mono(meth)acrylate having 1 to 100 ethylene oxide groups; and (b-14) diorganopolysiloxanes composed of 1 to 200 siloxane units and having a radical polymerizable functional group at one end, for example, dimethylpolysiloxane containing a (meth)acryloxypropyl group at one end, and dimethylpolysiloxane containing a styryl or α-methylstyryl group at one end. These vinyl monomers may be used alone or in admixture of any.

It is preferred that the alkyl (meth)acrylates in which the alkyl moiety has 1 to 18 carbon atoms account for 1 to 100 mol % of the vinyl monomers. Less than 1 mol % of the alkyl (meth)acrylates may fail to provide the desired properties such as gloss and high optical density. The preferred content of alkyl (meth)acrylates is 30 to 99 mol % of the vinyl monomers. Where it is desired to enhance gloss and optical density, a radical polymerizable vinyl monomer having a crosslinkable functional group may be copolymerized. Especially preferred are those vinyl monomers having an epoxy functional group for which crosslinking due to ring-opening reaction of carboxylic acid/epoxy group is expectable, which are classified in (b-7) glycidyl group-containing vinyl monomers such as glycidyl (meth)acrylate and glycidyl allyl ether.

Where it is desired to impart slight water repellency to the surface, a diorganopolysiloxane having a radical polymerizable functional group at one end as classified in (b-14) may be copolymerized.

According to the invention, 100 to 100,000 parts by weight of the radical polymerizable vinyl monomer (b) is used per 100 parts by weight of component (a) consisting of components (a-1) and/or (a-2). Less than 100 parts of component (b) leads to insufficient moisture absorption. More than 100,000 parts of component (b) leads to a lack of dimensional stability. Preferably the radical polymerizable vinyl monomer (b) is used in an amount of 500 to 10,000 parts by weight per 100 parts by weight of component (a).

The emulsion composition of the invention is an emulsion polymerized product of the silicone resin and/or radical polymerizable vinyl group-containing alkoxysilane and the radical polymerizable vinyl monomer and is substantially free of organic solvents. The term "organic solvent" encompasses all solvents known in the art, including alcohols such as methanol, ethanol, propanol, isopropanol, butanol, t-butanol, hexanol, cyclohexanol, and phenol; aromatics such as toluene and xylene; ketones such as acetone, methyl ethyl ketone, methyl isobutyl ketone and cyclohexanone; esters such as ethyl acetate, butyl acetate, isobutyl acetate and ethyl lactate; ethers such as diethyl ether, dibutyl ether, tetrahydrofuran, and dioxane; ethylene glycol derivatives such as ethylene glycol monomethyl ether, ethylene glycol monobutyl ether, and ethylene glycol monobutyl ether acetate; propylene glycol derivatives such as propylene glycol monomethyl ether and propylene glycol monomethyl ether acetate; acetonitrile, dimethyl sulfoxide, and dimethylformamide. It is preferred that the emulsion composition be substantially free of these solvents because they can cause environmental pollution, be harmful to humans, impair the stability of the emulsion or obstruct formation of a uniform film after coating.

However, as mentioned previously, conventional methods known thus far was impossible to form a composite emulsion of silicone resin plus acrylic resin which is substantially free of a solvent. This is because a silicone resin terminated with a silanol group having high reactivity, if in low molecular weight form, is soluble in water, but in the absence of an organic solvent, is unstable and undergoes considerable changes with time, and inversely, if in high molecular weight form, is fairly stable, but is insoluble in water and tends to solidify in the absence of an organic solvent, making it difficult to emulsify. It was then a common practice in the prior art to use an organic solvent in admixture with water or to use an alkoxysilane compound or partial hydrolyzate thereof as the starting reactant. According to the invention, the silicone resin is polycondensed to such a level that the silicone resin alone is insoluble in water; the organic solvents including alcohol and other by-products formed upon hydrolysis of the hydrolyzable silane compound are removed as much as possible from the silicone resin solution prior to emulsion polymerization; and the silicone resin solution is converted to a solution of the silicone resin in the radical polymerizable vinyl monomer, which is subjected to emulsion polymerization. Then the emulsion substantially free of an organic solvent is obtained. Accordingly, the emulsion of the invention has a possibility to contain a trace amount of organic solvent which cannot be removed. To avoid the above problems, the content of organic solvent should preferably be up to 5% by weight, especially up to 2% by weight based on components (a) and (b) combined.

The emulsion composition of the invention is obtained by emulsion polymerization of a solution which contains as main components the singly water insoluble, silanol group-bearing silicone resin and/or the radical polymerizable vinyl group-bearing alkoxysilane and the radical polymerizable vinyl monomer and which is substantially free of an organic solvent, that is, has an organic solvent content within the above-limited range.

A surfactant is used upon emulsion polymerization. Use may be made of prior art well-known nonionic, cationic, and anionic surfactants as well as reactive emulsifiers having radical polymerizable functional groups. Exemplary surfactants include nonionic surfactants such as polyoxyethylene alkyl ethers, polyoxyethylene alkyl phenyl ethers, polyoxyethylene carboxylic esters, sorbitan fatty acid esters, and polyoxyethylene sorbitan fatty acid esters; cationic surfactants such as alkyltrimethylammonium chloride and alkylbenzylammonium chloride; anionic surfactants such as alkyl or alkylallyl sulfates, alkyl or alkylallyl sulfonates, and dialkyl sulfosuccinates; ampholytic ion surfactants such as of amino acid and betaine types; and various reactive surfactants including derivatives of radical polymerizable (meth)acrylate, styrene and maleate compounds having a hydrophilic group such as sulfonate salt, polyoxyethylene chain or quaternary ammonium salt in a molecule as described in JP-A 8-27347. These surfactants are illustrated below.

(1)

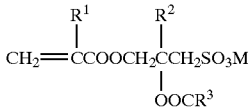

$R^1$, $R^2$: H, $CH_3$
$R^3$: $C_{7-21}$ alkyl, alkenyl
M: alkali metal, ammonium
(see JP-A 54-144317)

(2)

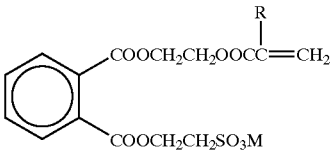

R: H, $CH_3$
M: alkali metal, ammonium, amine
(see JP-A 55-115419)

(3)

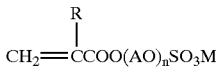

R: H, $CH_3$
A: alkylene
n: integer of at least 2
M: mono- or divalent cation
(see JP-A 62-34947)

(4)

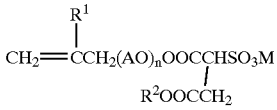

$R^1$: H, $CH_3$
$R^2$: substituted or unsubstituted hydrocarbon, etc.
A: $C_{2-4}$ alkylene, substituted alkylene
n: 0, positive number
(see JP-B 49-46291)

-continued (5)

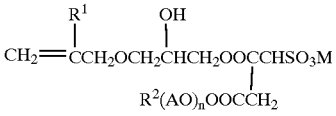

$R^1$: H, $CH_3$
$R^2$: substituted or unsubstituted hydrocarbon, amino, etc.
A: $C_{2-4}$ alkylene
n: 0–100
M: mono- or divalent cation
(see JP-A 58-203960)

(6)

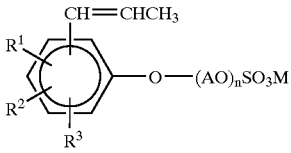

$R^1$: $C_{6-18}$ alkyl etc.
$R^2$: H, $C_{6-18}$ alkyl, etc.
$R^3$: H, propenyl
A: $C_{2-4}$ alkylene, substituted alkylene
M: alkali metal, etc.
n: 1–200
(see JP-A 4-53802

(7)

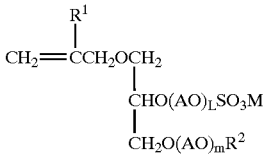

$R^1$: H, $CH_3$
$R^2$: $C_{8-24}$ hydrocarbon, etc.
A: $C_{2-4}$ alkylene
M: H, alkali metal, alkaline earth metal, etc.
L: 0–20
m: 0–50
(see JP-A 62-104802)

(8)

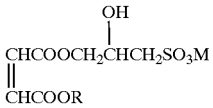

R: $C_{8-22}$ hydrocarbon
M: alkali metal, ammonium
(see JP-A 49-40388)

(9)

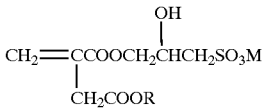

R: $C_{8-22}$ hydrocarbon
M: alkali metal, ammonium
(see JP-A 49-40388)

(10)

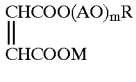

R: alkyl, alkylphenyl
A: ethylene
M: ammonium, amine, alkali metal
m: 9, 12, 14, 28
(see JP-A 52-134658)

(11)

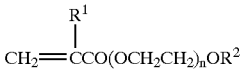

$R^1$: H, $CH_3$
$R^2$: H, $CH_3$, $-C_6H_4-(CH_2)_m-H$
n: 4–30
(see JP-A 53-126093)

(12)

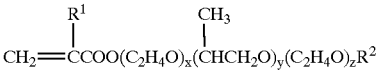

$R^1$, $R^2$: H, $CH_3$
x: 0–100
y: 0–100
z: 0–100
$1 \leq x + y + z \leq 100$
(see JP-A 56-28208)

(13)

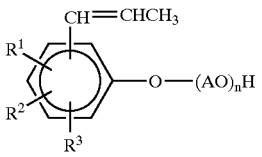

$R^1$: $C_{6-18}$ alkyl, etc.
$R^2$: H, $C_{6-18}$ alkyl, etc.
$R^3$: H, propenyl
A: $C_{2-4}$ alkylene, substituted alkylene
n: 1–200
(see JP-A 4-50204)

-continued (14)

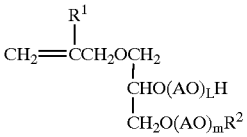

$R^1$: H, $CH_3$
$R^2$: $C_{6-24}$ hydrocarbon, acyl
A: $C_{2-4}$ alkylene
L: 0–100
m: 0–50
(see JP-A 62-104802)

(15)

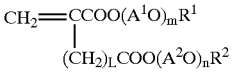

$R^1$, $R^2$: H, $C_{1-24}$ hydrocarbon, acyl
$A^1$, $A^2$: $C_{2-4}$ alkylene, substituted alkylene
L: 1, 2
m, n: 0, positive number,
$m + n \geq 3$, $m + n \geq 1$
when $R^1$ and $R^2$ are H
(see JP-A 50-98484)

These surfactants may be used alone or in admixture. An appropriate amount of the surfactant used is about 0.5 to 15% by weight, especially about 1 to 10% by weight based on the total of effective components, i.e., components (a) and (b) combined.

For emulsion polymerization, a radical polymerization initiator is often used. Examples of the polymerization initiator include persulfates such as potassium persulfate and ammonium persulfate; water-soluble initiators such as aqueous hydrogen peroxide, t-butylhydroperoxide, t-butylperoxymaleic acid, succinic acid peroxide, and 2,2'-azobis(2-N-benzylamidino)propane hydrogen chloride; oil-soluble initiators such as benzoyl peroxide, cumenehydroperoxide, dibutyl peroxide, diisopropylperoxydicarbonate, cumylperoxyneodecanoate, cumylperoxyoctoate, and azoisobutyronitrile; and redox initiators combined with reducing agents such as acidic sodium sulfite, Rongalit and ascorbic acid. An appropriate amount of the polymerization initiator used is about 0.1 to 10% by weight, especially about 0.5 to 5% by weight based on the radical polymerizable vinyl monomer (b).

It is now described how to prepare the emulsion of the invention. In the embodiment using the silanol group-bearing silicone resin (a-1), the preferred emulsion preparation method is generally divided into two types. The first method involves the first step of distilling off the organic solvent from the solution of the silanol group-bearing silicone resin which is insoluble in water by itself, leaving essentially the effective component, the second step of adding the silicone resin from which the organic solvent has been removed to a radical polymerizable vinyl monomer and dissolving the silicone resin in the vinyl monomer to form a solution thereof, and the third step of emulsion polymerizing the vinyl monomer solution of the silicone resin resulting from the second step and/or a radical polymerizable vinyl group-bearing alkoxysilane in the presence of a surfactant, forming an emulsion. In the step of distilling off the solvent, it is recommended to carry out distillation at an operably low temperature so that highly active silanol groups may remain intact. Since the organic solvent is once separated, this method is suited to apply to a fully stable silicone resin having a relatively low silanol group content. If necessary, the first step may employ the so-called solvent exchange technique of exchanging the solvent with a radical polymerizable vinyl monomer, that is, the organic solvent may be distilled off in the co-presence of a radical polymerizable vinyl monomer having a relatively high boiling point. Useful techniques for emulsion polymerization include prior art well-known techniques, for example, a batchwise technique of emulsifying the entire vinyl monomer solution, followed by polymerization, a monomer replenishment technique of continuously replenishing the vinyl monomer solution or emulsion while effecting polymerization, a seed polymerization technique of previously polymerizing part of the emulsion and then replenishing the reminder of the emulsion while effecting polymerization, and a core/shell polymerization technique of forming the core and the shell from different monomer compositions.

Preferably, an emulsion of the radical polymerizable vinyl monomer solution is prepared by adding the solution to an aqueous solution of a surfactant and emulsifying the mixture in a homomixer or high pressure homogenizer. Emulsion polymerization is effected at 10 to 90° C. and preferably completed within 3 to 8 hours at 30 to 80° C.

The second method involves the first step of hydrolyzing the hydrolyzable silane compound in water and subjecting the hydrolyzate to polycondensation to form a reaction mixture containing the silanol group-terminated silicone resin (a-1), the second step of distilling off organic solvents such as alcohols and other hydrolytic by-products from the reaction mixture, leaving only a mixture of the silanol group-bearing silicone resin component (a-1) and water wherein the silicone resin is present dispersed or undissolved in water, the third step of adding a radical polymerizable vinyl monomer thereto for dissolving the silicone resin in the vinyl monomer, and separating the silicone resin from the water layer as a radical polymerizable vinyl monomer solution of the silicone resin, and the fourth step of emulsion polymerizing the vinyl monomer solution of the silicone resin resulting from the third step in the presence of a surfactant, forming an emulsion. This method can suppress condensation of highly reactive silanol groups because the state that the silicone resin is present by itself is excluded throughout the steps. Accordingly, the second method is suited to apply to a silicone resin which is rich in silanol groups, but water insoluble. The second method is preferred because the silicone resin having undergone hydrolysis and condensation in water is fully water resistant and effectively curable as compared with a silicone resin of the same composition prepared in an organic solvent.

In the embodiment using the radical polymerizable vinyl group-bearing alkoxysilane (a-2), the emulsion preparation method involves the first step of adding the alkoxysilane to a radical polymerizable vinyl monomer for dissolving the alkoxysilane in the vinyl monomer and the second step of emulsion polymerizing the vinyl monomer solution of the alkoxysilane resulting from the first step in the presence of a surfactant, forming an emulsion. In this embodiment too, it is recommended to distill off the solvent at an operably low temperature. If necessary, the so-called solvent exchange technique of exchanging the solvent with a radical polymerizable vinyl monomer may be employed, that is, the organic solvent may be distilled off in the co-presence of a radical polymerizable vinyl monomer having a relatively high boiling point. Useful techniques for emulsion polymerization include prior art well-known techniques, for example, a batchwise technique of emulsifying the entire vinyl monomer solution, followed by polymerization, a monomer replenishment technique of continuously replenishing the vinyl monomer solution or emulsion while effecting polymerization, a seed polymerization technique of previously polymerizing part of the emulsion and then replenishing the reminder of the emulsion while effecting polymerization, and a core/shell polymerization technique of forming the core and the shell from different monomer compositions.

Printing Paper Sheet

The printing paper sheets used herein may be conventional plain copy paper having a basis weight of about 50 to 130 g/cm$^2$, and typically about 52.3 to 129 g/cm$^2$. After printing paper is coated or impregnated with the emulsion of the invention, any well-known surface treatment may be carried out if necessary.

Coating of Cellulose Fibers with Emulsion (1) Coating Method (A) Preparation of Coating Solution The aqueous emulsion obtained by the above method is adjusted to an appropriate concentration by adding water if necessary, and adjusted to an appropriate viscosity by adding a thickener if necessary. Also, terra abla, satin white, magnesium carbonate, calcium carbonate, and titanium oxide, etc. may be added to the emulsion in such amounts that they do not alter the viscosity and stability of the emulsion. A water absorbing polymer such as polyvinyl alcohol may be added to the emulsion in order that printing paper be endowed with water absorbing ability and softness.

(B) Application

The emulsion may be applied after the paper making step, for example, during the sizing step or after drying. For the coating purpose, the emulsion is preferably adjusted to a relatively high concentration, for example, of about 10 to 67% by weight. The coverage of the emulsion is preferably about 0.01 to 20 g/m$^2$ on a solids basis. The emulsion is applied to one or both surfaces of printing paper using various applicators, for example, a brush coater, air knife coater, and roll coater. Preferably the coated paper is then passed through a tunnel dryer or the like for drying.

(2) Impregnating Method (A) Preparation of Impregnating Solution

For the impregnation purpose, the emulsion is preferably set at a relatively low concentration, for example, of about 1 to 10% by weight.

(B) Impregnation

Impregnation with the emulsion is preferably carried out during the paper making step, but may be carried out during the sizing step or after drying. The amount of the emulsion with which paper is impregnated is preferably about 0.01 to 20 g/m$^2$ on a solids basis. After impregnation, any well-known surface treatment may be carried out on the paper if necessary.

Coating

Where paper sheets are used in an ink jet printer, emulsion application (by coating or impregnation) may be followed by surface coating in order to improve the clearness or sharpness of printed image. Any of well-known coating agents may be used. For example, a composition comprising polyvinyl alcohol, an acrylic resin, silica particles, polyvinyl pyrrolidone and quaternary amine is useful as well as a composition comprising silica aerogel, an acrylic resin and a polyacetal resin.

EXAMPLE

Synthesis Examples and Examples are given below for illustrating the invention. These examples are not to be construed as limiting the invention thereto. All parts are by weight.

Synthesis Example 1

In a nitrogen atmosphere and at 0° C., a 2-liter flask was charged with 408 g (3.0 mol) of methyltrimethoxysilane, to which 786 g of water was added and thoroughly mixed. To the flask under ice cooling, 216 g of 0.05N aqueous hydrochloric acid was added dropwise over 40 minutes for hydrolytic reaction. After the completion of dropwise addition, agitation was continued for one hour below 10° C. and for a further 2 hours at room temperature until the hydrolytic reaction was completed.

Then, methanol formed and water were vacuum distilled off under conditions of 70° C. and 60 Torr. Distillation was continued until no methanol was detected in the distillate. The detection of methanol ceased when concentration proceeded to 88% of the initial and at this point, the solution turned white turbid. The solution was allowed to stand for one day, during which time the solution separated into two layers, that is, the silicone resin settled down.

An aliquot was sampled out from the solution, and the precipitated silicone resin was separated from water by dissolving it in methyl isobutyl ketone. After drying, the silanol groups in the silicone resin were quantitatively determined by reaction with methyl Grignard reagent. The silanol group content was 8.2% based on the silicone resin. On GPC analysis, the silicone resin had a number average molecular weight of $1.8\times10^3$. An infrared absorption spectral analysis showed the absence of residual methoxy groups. It was thus ascertained that the silicone resin (A) obtained had the average compositional formula below. Then this silicone resin (A) would yield no organic solvents as by-products.

$$(CH_3)_{1.0}Si(OH)_{0.34}O_{1.33}$$

To the above solution was added 300 g (3 mol) of methyl methacrylate (MMA). The once precipitated silicone resin was dissolved in the MMA and isolated from the aqueous layer as a MMA solution of the silicone resin. There was obtained 505 g of the MMA solution, abbreviated as A/MMA, having a nonvolatile content of 40.2% (105° C./3 hours).

Thereafter, a polymerizer equipped with a stirrer, condenser, thermometer and nitrogen gas inlet was charged with 730 parts of deionized water, 0.47 part of sodium carbonate as a pH buffering agent, and 4.70 parts of boric acid. With stirring, the polymerizer was heated to 60° C. before it was purged with nitrogen. To the mixture were added 1.75 parts of Rongalit, 0.12 part of a 1% aqueous solution of disodium ethylenediaminetetraacetate, and 0.04 part of a 1% aqueous solution of ferrous sulfate. At the same time, a mixture of 175 parts of the MMA solution of the silicone resin (A/MMA), 385 parts of methyl methacrylate (MMA), 140 parts of butyl acrylate, 2.1 parts of t-butylhydroperoxide (69% pure), 14.0 parts of reactive surfactant Aqualon RN-20 and 7.0 parts of Aqualon HS-10 (trade name, Dai-ichi Kogyo Selyaku Co. Ltd.) was constantly added to the polymerizer over 2.5 hours while the temperature was maintained at 60° C. Reaction was continued at 60° C. for a further 2 hours to complete polymerization. The resulting emulsion (emulsion A) had a solids concentration of 50.1% and pH 7.0.

Synthesis Example 2

A 2-liter flask was charged with 408 g (3.0 mol) of methyltrimethoxysilane and 300 g of toluene. With stirring at 40° C., 41 g of 2% aqueous hydrochloric acid (2.23 mol of water) was added dropwise over one hour for hydrolysis. With stirring, the solution was ripened at 40° C. for one hour. Then 100 g of a 10% aqueous sodium sulfate solution was added to the solution, which was stirred for 10 minutes and allowed to stand, whereupon the water layer was removed. This water washing procedure was repeated three times. From the silicone resin solution thus obtained, methanol and toluene were vacuum distilled off under conditions of 50° C. and 50 Torr. Subsequent filtration gave a toluene solution of the silicone resin.

On GPC analysis, the silicone resin had a number average molecular weight of $2.0\times10^3$. On quantitative determination of silanol groups, the silanol group content was 4.2% based on the silicone resin. On quantitative determination of methoxy groups by a cracking process, the methoxy group content was 1.4% based on the silicone resin. It was thus ascertained that the silicone resin (B) had the compositional formula below. Then this silicone resin (B) would yield at most 1.4% based on the silicone resin of methanol as by-product.

$$(CH_3)_{1.0}Si(OH)_{0.17}(OCH_3)_{0.03}O_{1.40}$$

From the toluene solution, the toluene was vacuum distilled off under such conditions of 50° C. and 10 Torr that little condensation reaction took place. The silicone resin was powdered. The powdered silicone resin (B) had a nonvolatile content of 0.3% (105° C./3 hours). The powdered silicone resin was dissolved in methyl methacrylate (MMA) to form a MMA solution containing 40% the silicone resin (B-1/MMA).

Thereafter, a polymerizer equipped with a stirrer, condenser, thermometer and nitrogen gas inlet was charged with 730 parts of deionized water, 0.47 part of sodium carbonate as a pH buffering agent, and 4.70 parts of boric acid. With stirring, the polymerizer was heated to 60° C. before it was purged with nitrogen. To the mixture were added 1.75 parts of Rongalit, 0.12 part of a 1% aqueous solution of disodium ethylenediaminetetraacetate, and 0.04 part of a 1% aqueous solution of ferrous sulfate. At the same time, a mixture of 175 parts of the MMA solution of the silicone resin (B-1/MMA), 385 parts of methyl methacrylate (MMA), 140 parts of butyl acrylate, 2.1 parts of t-butylhydroperoxide (69% pure), 14.0 parts of reactive surfactant Aqualon RN-20 and 7.0 parts of Aqualon HS-10 (trade name, Dai-ichi Kogyo Seiyaku Co. Ltd.) was constantly added to the polymerizer over 2.5 hours while the temperature was maintained at 60° C. Reaction was continued at 60° C. for a further 2 hours to complete polymerization. The resulting emulsion (emulsion B-1) had a solids concentration of 50.9% and pH 7.0.

Synthesis Example 3

A polymerizer equipped with a stirrer, condenser, thermometer and nitrogen gas inlet was charged with 300 parts of deionized water, 0.47 part of sodium carbonate as a pH buffering agent, and 4.7 parts of boric acid. With stirring, the polymerizer was heated to 60° C. before it was purged with nitrogen. To the mixture were added 1.75 parts of Rongalit, 0.12 part of a 1% aqueous solution of disodium ethylenediaminetetraacetate, and 0.04 part of a 1% aqueous solution of ferrous sulfate. Separately, a uniform mixture of 175 parts of the MMA solution of the silicone resin (B-1/MMA), 385 parts of methyl methacrylate (MMA), 108 parts of butyl acrylate, 30 parts of 2-[2'-hydroxy-5'-(2-methacryloxyethyl)phenyl]-2H-benzotriazole, 2 part of 1,2,2,6,6-pentamethyl-4-piperidinyl methacrylate, and 2.1 parts of t-butylhydroperoxide (69% pure) was added to an aqueous solution containing 400 parts of ion-exchanged water, 7.0 parts of sodium laurylsulfate and 14.0 parts of Noigen EA-170 (trade name, Dai-ichi Kogyo Seiyaku Co. Ltd.) and emulsified in a homomixer to form 1,121 parts of an emulsion. A 56 part portion of the emulsion was added to the polymerizer to carry out seed polymerization. Subsequently, the remainder of the emulsion was constantly added to the polymerizer over 3.5 hours while the temperature was maintained at 60° C. Reaction was continued at 60° C. for a further 2 hours to complete polymerization. The resulting emulsion (emulsion B-2) had a solids concentration of 50.1% and pH 7.5.

Synthesis Example 4

The powdered silicone resin synthesized in Synthesis Example 2 was dissolved in methyl methacrylate (MMA) to form a MMA solution containing 20% the silicone resin (B-2/MMA).

Thereafter, a polymerizer equipped with a stirrer, condenser, thermometer and nitrogen gas inlet was charged with 730 parts of deionized water, 0.47 part of sodium carbonate as a pH buffering agent, and 4.70 parts of boric acid. With stirring, the polymerizer was heated to 60° C. before it was purged with nitrogen. To the mixture were added 1.75 parts of Rongalit, 0.12 part of a 1% aqueous solution of disodium ethylenediaminetetraacetate, and 0.04 part of a 1% aqueous solution of ferrous sulfate. At the same time, a mixture of 175 parts of the MMA solution of the silicone resin (B-2/MMA), 385 parts of methyl methacrylate (MMA), 140 parts of butyl acrylate, 2.1 parts of t-butylhydroperoxide (69% pure), 14.0 parts of reactive surfactant Aqualon RN-20 and 7.0 parts of Aqualon HS-10 (trade name, Dai-ichi Kogyo Seiyaku Co. Ltd.) was constantly added to the polymerizer over 2.5 hours while the temperature was maintained at 60° C. Reaction was continued at 60° C. for a further 2 hours to complete polymerization. The resulting emulsion (emulsion B-3) had a solids concentration of 50.9% and pH 7.0.

Synthesis Example 5

A silicone resin was prepared as in Synthesis Example 1, aside from using 326.4 g (2.4 mol) of methyltrimethoxysilane, 36 g (0.3 mol) of dimethyldimethoxysilane and 70.8 g (0.3 mol) of 3-glycidoxypropyltrimethoxysilane instead of the methyltrimethoxysilane.

On GPC analysis, the silicone resin had a number average molecular weight of $1.6\times10^3$. On quantitative determination of silanol groups, the silanol group content was 8.6% based on the silicone resin. No methoxy groups were included. It was thus ascertained that the silicone resin (C) had the compositional formula below. Then this silicone resin (C) would yield no organic solvents as by-product.

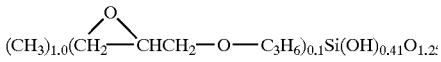

Methyl methacrylate (MMA) was added to the above aqueous solution whereby the once precipitated silicone resin was dissolved in the MMA and isolated from the aqueous layer as a MMA solution containing 20.1% of the silicone resin (C/MMA).

Thereafter, a polymerizer equipped with a stirrer, condenser, thermometer and nitrogen gas inlet was charged with 730 parts of deionized water, 0.47 part of sodium carbonate as a pH buffering agent, and 4.70 parts of boric acid. With stirring, the polymerizer was heated to 60° C. before it was purged with nitrogen. To the mixture were added 1.75 parts of Rongalit, 0.12 part of a 1% aqueous solution of disodium ethylenediaminetetraacetate, and 0.04 part of a 1% aqueous solution of ferrous sulfate. At the same time, a mixture of 175 parts of the MMA solution of the silicone resin (C/MMA), 385 parts of methyl methacrylate (MMA), 70 parts of butyl acrylate, 35 parts of acrylic acid, 35 parts of styrene, 2.1 parts of t-butylhydroperoxide (69% pure), 14.0 parts of reactive surfactant Aqualon RN-20 and 7.0 parts of Aqualon HS-10 (trade name, Dai-ichi Kogyo Seiyaku Co. Ltd.) was constantly added to the polymerizer over 2.5 hours while the temperature was maintained at 60° C. Reaction was continued at 60° C. for a further 2 hours to complete polymerization. The resulting emulsion (emulsion C) had a solids concentration of 50.2% and pH 7.3.

Synthesis Example 6

A silicone resin was prepared as in Synthesis Example 1, aside from using 326.4 g (2.4 mol) of methyltrimethoxysilane, 65.4 g (0.3 mol) of trifluoropropyltrimethoxysilane and 74.4 g (0.3 mol) of 3-methacryloxypropylmethyldimethoxysilane instead of the methyltrimethoxysilane.

On GPC analysis, the silicone resin had a number average molecular weight of $1.3\times10^3$. On quantitative determination of silanol groups, the silanol group content was 9.2% based on the silicone resin. No methoxy groups were included. It was thus ascertained that the silicone resin (D) had the compositional formula below. Then this silicone resin (D) would yield no organic solvents as by-product.

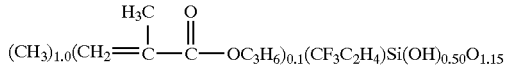

A 80/20 mixture of methyl methacrylate (MMA) and butyl acrylate (BA) was added to the above aqueous solution whereby the once precipitated silicone resin was dissolved in the MMA-BA and isolated from the aqueous layer as a MMA-BA solution containing 20.2% of the silicone resin (D/MMA-BA).

Thereafter, a polymerizer equipped with a stirrer, condenser, thermometer and nitrogen gas inlet was charged with 730 parts of deionized water, 0.47 part of sodium carbonate as a pH buffering agent, and 4.70 parts of boric acid. With stirring, the polymerizer was heated to 60° C. before it was purged with nitrogen. To the mixture were added 1.75 parts of Rongalit, 0.12 part of a 1% aqueous solution of disodium ethylenediaminetetraacetate, and 0.04 part of a 1% aqueous solution of ferrous sulfate. At the same time, a mixture of 175 parts of the MMA solution of the silicone resin (D/MMA-BA), 385 parts of methyl methacrylate (MMA), 70 parts of butyl acrylate, 35 parts of glycidyl methacrylate, 35 parts of dimethylsilicone fluid capped with an acrylic group at one end, 2.1 parts of t-butylhydroperoxide (69% pure), 14.0 parts of reactive surfactant Aqualon RN-20 and 7.0 parts of Aqualon HS-10 (trade name, Dai-ichi Kogyo Seiyaku Co. Ltd.) was constantly added to the polymerizer over 2.5 hours while the temperature was maintained at 60° C. Reaction was continued at 60° C. for a further 2 hours to complete polymerization. The resulting emulsion (emulsion D) had a solids concentration of 50.3% and pH 7.2.

Synthesis Example 7

A polymerizer equipped with a stirrer, condenser, thermometer and nitrogen gas inlet was charged with 730 parts of deionized water, 0.47 part of sodium carbonate as a pH buffering agent, and 4.70 parts of boric acid. With stirring, the polymerizer was heated to 60° C. before it was purged with nitrogen. To the mixture were added 1.75 parts of Rongalit, 0.12 part of a 1% aqueous solution of disodium ethylenediaminetetraacetate, and 0.04 part of a 1% aqueous solution of ferrous sulfate. At the same time, a mixture of 399 parts of methyl methacrylate (MMA), 301 parts of butyl acrylate, 16.8 parts of 3-methacryloxypropylmethyldimethoxysilane, 4.2 parts of 3-methacryloxypropyltrimethoxysilane, 2.1 parts of t-butylhydroperoxide (69% pure), 14.0 parts of reactive surfactant Aqualon RN-20 and 7.0 parts of Aqualon HS-10 (trade name, Dai-ichi Kogyo Seiyaku Co. Ltd.) was constantly added to the polymerizer over 2.5 hours while the temperature was maintained at 60° C. Reaction was continued at 60° C. for a further 2 hours to complete polymerization. The resulting emulsion (emulsion E) had a solids concentration of 50.8% and pH 7.0.

Synthesis Example 8

A 200-ml reactor equipped with a stirrer, thermometer and condenser was charged with 120 g (6.67 mol) of water. With stirring, a mixture of 55.6 g (0.25 mol) of $H_2NCH_2CH_2NHCH_2CH_2CH_2Si(OCH_3)_3$ and 10.4 g (0.05 mol) of $Si(OCH_2CH_3)_4$ was added dropwise over 10 minutes at room temperature whereupon the solution temperature rose from 27° C. to 49° C. The solution was heated at 60 to 70° C. in an oil bath and stirred for one hour at the temperature. With an ester adapter attached to the reactor, the solution temperature was raised to 98° C. whereby methanol and ethanol by-products were removed. There was obtained 137 g of an aqueous solution of an organosilicon compound (aqueous solution F). The aqueous solution had a nonvolatile content of 31.1% (105° C./3 hours)

Synthesis Example 9

A 200-ml reactor equipped with a stirrer, thermometer and condenser was charged with 120 g (6.67 mol) of water. With stirring, a mixture of 66.6 g (0.30 mol) of $H_2NCH_2CH_2NHCH_2CH_2CH_2Si(OCH_3)_3$ and 4.1 g (0.03 mol) of $CH_3Si(OCH_3)_3$ was added dropwise over 10 minutes at room temperature whereupon the solution temperature rose from 27° C. to 49° C. The solution was heated at 60 to 70° C. in an oil bath and stirred for one hour at the temperature. With an ester adapter attached to the reactor, the solution temperature was raised to 98° C. whereby methanol by-product was removed. There was obtained 149 g of an aqueous solution of an organosilicon compound (aqueous solution G). The aqueous solution had a nonvolatile content of 28.7% (105° C./3 hours)

Example 1

On plain paper sheets having a basis weight of 64 g/m$^2$, each of the emulsions or aqueous solutions prepared in Synthesis Examples 1 to 9 was applied by means of a coater in a coverage of 10 g/m$^2$ and dried by passing through heating rolls. The resulting gel-coated paper sheets (Sample Nos. 1–9) were smooth on their surface. Using an ink jet printer BJC-430J (Canon Inc.) and color ink BC-21e, a color image was printed on the paper sheets. The state of paper after ink drying was observed. The criteria for rating the deformation of paper sheet and the sharpness of printed image are given below. The same test was carried out on plain paper sheets which had not been coated with the emulsion or aqueous solution (Sample No. 10).

The test results are shown in Table 1.

(1) Deformation of printed paper sheet
- Excellent: no deformation or cockle
- Fair: deformation in the form of some cockles
- Poor: marked cockles (2) Sharpness of printed image
- Excellent: very sharp, no bleeding
- Fair: some bleeding
- Poor: marked bleeding

TABLE 1

| | Sample No. | Emulsion or aqueous solution | Deformation | Sharpness |
|---|---|---|---|---|
| Example | 1 | A | Excellent | Excellent |
| | 2 | B-1 | Excellent | Excellent |
| | 3 | B-2 | Excellent | Excellent |
| | 4 | B-3 | Excellent | Excellent |
| | 5 | C | Excellent | Excellent |
| | 6 | D | Excellent | Excellent |
| | 7 | E | Excellent | Excellent |
| Comparative Example | 8 | F | Excellent | Fair |
| | 9 | G | Excellent | Fair |
| | 10 | — | Poor | Poor |

Note:
Sample No. 10 is a control paper sheet which was not impregnated with the emulsion or aqueous solution.

It is evident from the above results that the plain paper sheets coated with the emulsions of the invention do not undergo any deformation after printing by an ink jet printer. In addition, the sharpness of printed image is equal to that on ordinary coated paper sheets. In contrast, paper sheets coated with the aqueous solutions of organosilicon compounds are somewhat poor in sharpness. Ordinary plain paper sheets (Sample No. 10) became cockled or wavy after printing.

Example 2

The emulsions or aqueous solutions of Synthesis Examples 1 to 9 were diluted with water by a volumetric factor of 20. Paper sheets were made in the dilutions and passed between heating rolls for drying, obtaining printing paper sheets having a basis weight of 64 g/m$^2$. The resulting paper sheets impregnated with the emulsions or aqueous solutions (Sample Nos. 11–19) were smooth on their surface.

Using the ink jet printer BJC-430J (Canon Inc.) and color ink BC-21e, a color image was printed on the paper sheets as in Example 1. The paper sheets after ink drying were visually observed for the deformation of paper sheet and the sharpness of printed image. The same test was carried out on paper sheets which were made in the absence of the emulsion or aqueous solution (Sample No. 20). The criteria for rating deformation and sharpness are the same as in Example 1.

The test results are shown in Table 2.

TABLE 2

| | Sample No. | Emulsion or aqueous solution | Deformation | Sharpness |
|---|---|---|---|---|
| Example | 11 | A | Excellent | Excellent |
| | 12 | B-1 | Excellent | Excellent |
| | 13 | B-2 | Excellent | Excellent |
| | 14 | B-3 | Excellent | Excellent |
| | 15 | C | Excellent | Excellent |

TABLE 2-continued

| | Sample No. | Emulsion or aqueous solution | Deformation | Sharpness |
|---|---|---|---|---|
| | 16 | D | Excellent | Excellent |
| | 17 | E | Excellent | Excellent |
| Comparative | 18 | F | Excellent | Fair |
| Example | 19 | G | Excellent | Fair |
| | 20 | — | Poor | Poor |

Note:
Sample No. 20 is a control paper sheet which was not impregnated with the emulsion or aqueous solution.

It is evident from the above results that the plain paper sheets made in the emulsions of the invention do not undergo any deformation after printing by an ink jet printer. In addition, the sharpness of printed image is equal to that on ordinary coated paper sheets. In contrast, paper sheets made in the aqueous solutions of organosilicon compounds are somewhat poor in sharpness. Ordinary plain paper sheets (Sample No. 20) became cockled or wavy after printing.

There have been described ink jet printing paper sheets in which cellulose fibers are coated with an acrylic silicone resin resulting from an acrylic silicone emulsion so that the paper sheet is minimized in deformation or stretching and contraction upon water absorption. Even when the paper sheets are printed by an ink jet printer, deformation like stretching, curl or cockle is minimized and the quality of printed image is at a level equal to that on ordinary coated paper sheets. The invention can be applied to plain paper sheets and contributes to a cost reduction of printing paper sheets for ink jet printers.

Japanese Patent Application No. 2001-015372 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. An ink jet printing paper sheet comprising cellulose fibers coated at least in part upon paper making with solids of a substantially organic solvent-free, silicone resin-containing emulsion composition which is obtained by emulsion polymerization of a mixture comprising:

(a) 100 parts by weight of at least one of (a-1) a singly water insoluble, silanol group-bearing silicone resin having the following average compositional formula:

$$R^1_mR^2_nSi(OH)_p(OX)_qO_{(4-m-n-p-q)/2}$$

wherein $R^1$ is a monovalent hydrocarbon group having 1 to 10 carbon atoms, $R^2$ is a substituted monovalent hydrocarbon group having 1 to 10 carbon atoms, X is a monovalent hydrocarbon group having 1 to 6 carbon atoms, m, n, p and q are positive numbers satisfying $0.5 \leqq m \leqq 1.8$, $0 \leqq n \leqq 1.0$, $0 < p \leqq 1.5$, $0q \leqq 0.5$, $0.5 \leqq m+n \leqq 1.8$, $0 < p+q \leqq 1.5$, and $0.5 < m+n+p+q < 3$, and (a-2) a radical polymerizable vinyl group-bearing alkoxysilane having the following general formula:

$$CH_2{=}CR^3R^4_bSiR^5_a(OX)_{3-a}$$

wherein $R^3$ is hydrogen or methyl, $R^4$ is a divalent hydrocarbon group of 1 to 10 carbon atoms which may be separated by an oxygen atom, —COO— group or the like, $R^5$ is a substituted or unsubstituted monovalent hydrocarbon group having 1 to 8 carbon atoms, X is as defined above, "a" is 0 or 1, and "b" is 0 or 1, and (b) 100 to 100,000 parts by weight of a radical polymerizable vinyl monomer.

2. The ink jet printing paper of claim 1, wherein $R^1$ is selected from the group consisting of methyl, ethyl, propyl, isopropyl, butyl, t-butyl, hexyl, cyclohexyl, octyl, decyl and phenyl.

3. The ink jet printing paper of claim 1, wherein $R^2$ is selected from the group consisting of (1) halogen atoms, (2) alkenyl groups, (3) epoxy functional groups, (4) (meth) acrylic functional groups, (5) amino functional groups, (6) sulfurous functional groups, (7) (polyoxyalkylene) alkyl ether groups, (8) anionic groups, and (9) quaternary ammonium salt structure-containing groups.

4. The ink jet printing paper of claim 1, wherein X is selected from the group consisting of methyl, ethyl, and isopropyl groups.

5. The ink jet printing paper of claim 1, wherein m is from 0.6 to 1.5.

6. The ink jet printing paper of claim 1, wherein p is from 0.05 to 0.8.

7. The ink jet printing paper of claim 1, wherein p is from 0.2 to 0.7.

8. The ink jet printing paper of claim 1, wherein $R^3$ is a hydrocarbon group of 1 to 6 carbon atoms.

9. The ink jet printing paper of claim 1, wherein b is selected from the group consisting of (b-1) alkyl (meth) acrylates in which the alkyl moiety has 1 to 18 carbon atoms; (b-2) vinyl monomers containing a carboxyl group or anhydride group thereof; (b-3) hydroxyl group-containing vinyl monomers; (b-4) amide group-containing vinyl monomers; (b-5) amino group-containing vinyl monomers; (b-6) alkoxy group-containing vinyl monomers; (b-7) glycidyl group-containing vinyl monomers; (b-8) vinyl ester monomers; (b-9) aromatic vinyl monomers; (b-10) vinyl cyanide monomers; (b-11) vinyl halide monomers; (b-12) vinyl monomers containing at least two radical polymerizable unsaturated groups in a molecule; (b-13) (poly)oxyethylene chain-containing vinyl monomers; and (b-14) diorganopolysiloxanes composed of 1 to 200 siloxane units and having a radical polymerizable functional group at one end.

10. A method of producing an ink jet printing paper sheet comprising cellulose fibers wherein said process comprises coating upon said ink jet printing paper sheet, at least in part during paper making, solids of a substantially organic solvent-free, silicone resin-containing emulsion composition which is obtained by emulsion polymerization of a mixture comprising:

(a) 100 parts by weight of at least one of (a-1) a singly water insoluble, silanol group-bearing silicone resin having the following average compositional formula:

$$R^1_mR^2_nSi(OH)_p(OX)_qO_{(4-m-n-p-q)/2}$$

wherein $R^1$ is a monovalent hydrocarbon group having 1 to 10 carbon atoms, $R^2$ is a substituted monovalent hydrocarbon group having 1 to 10 carbon atoms, X is a monovalent hydrocarbon group having 1 to 6 carbon atoms, m, n, p and q are positive numbers satisfying $0.5 \leqq m \leqq 1.8$, $0 \leqq n \leqq 1.0$, $0 < p \leqq 1.5$, $0 \leqq q \leqq 0.5$, $0.5 \leqq m+n \leqq 1.8$, $0 < p+q \leqq 1.5$, and $0.5 < m+n+p+q < 3$, and (a-2) a radical polymerizable vinyl group-bearing alkoxysilane having the following general formula:

$$CH_2{=}CR^3R^4_bSiR^5_a(OX)_{3-a}$$

wherein $R^3$ is hydrogen or methyl, $R^4$ is a divalent hydrocarbon group of 1 to 10 carbon atoms which may be separated by an oxygen atom, —COO— group or the like, $R^5$ is a substituted or unsubstituted monovalent hydrocarbon group having 1 to 8 carbon atoms, X is as defined above, "a" is 0 or 1, and "b" is 0 or 1, and (b) 100 to 100,000 parts by weight of a radical polymerizable vinyl monomer.

* * * * *